US010767286B2

(12) United States Patent
Maleck et al.

(10) Patent No.: US 10,767,286 B2
(45) Date of Patent: Sep. 8, 2020

(54) DEVICE FOR PIECING A THREAT AT A WORKSTATION OF A TEXTILE MACHINE COMPRISING A SUCTION NOZZLE AND COMPRISING A FEEDER UNIT

(71) Applicant: Maschinenfabrik Rieter AG, Winterthur (CH)

(72) Inventors: Mario Maleck, Walting (DE); Robert Hagl, Rottenegg (DE); Thomas Gruber, Ingolstadt (DE); Robin Wein, Manching (DE); Christian Kettner, Koesching (DE); Bernd Bahlmann, Schrobenhausen (DE); Romeo Pohn, Geisenfeld/Rottenegg (DE)

(73) Assignee: Maschinenfabrik Rieter AG, Winterthur (CH)

( * ) Notice: Subject to any disclaimer, the term of this patent is extended or adjusted under 35 U.S.C. 154(b) by 62 days.

(21) Appl. No.: 16/149,241

(22) Filed: Oct. 2, 2018

(65) Prior Publication Data

US 2019/0100861 A1 Apr. 4, 2019

(30) Foreign Application Priority Data

Oct. 2, 2017 (DE) ..... 10 2017 122 851

(51) Int. Cl.
*D01H 15/00* (2006.01)
*B65H 67/08* (2006.01)
(Continued)

(52) U.S. Cl.
CPC ..... *D01H 15/00* (2013.01); *B65H 67/085* (2013.01); *B65H 75/241* (2013.01); *D01H 1/22* (2013.01); *B65H 2701/31* (2013.01); *D01H 4/48* (2013.01)

(58) Field of Classification Search
CPC ..... D01H 4/48; D01H 15/00; B65H 69/06; B65H 69/061; B65H 69/063; B65H 69/065; B65H 67/08; B65H 67/081; B65H 67/085
(Continued)

(56) References Cited

U.S. PATENT DOCUMENTS 3,532,243 A * 10/1970 Hart ..... B65D 41/0457 215/334
4,408,442 A * 10/1983 Rohner ..... B65H 69/061 57/22
(Continued)

FOREIGN PATENT DOCUMENTS

DE 10 2015 00539 A1 11/1916
DE 35 15 765 A1 11/1986
(Continued)

OTHER PUBLICATIONS

German Patent Office Search Report, dated Jun. 18, 2018.
EP Search Report, dated Feb. 13, 2019.

*Primary Examiner* — Shaun R Hurley
*Assistant Examiner* — Patrick J. Lynch
(74) *Attorney, Agent, or Firm* — Dority & Manning, P.A.

(57) ABSTRACT

A device for piecing a thread at a workstation of a textile machine includes a suction nozzle configured to pick up a thread end of the thread from a bobbin, the suction nozzle including an entry opening for the thread. A feeder unit is movable with respect to the suction nozzle and includes a cover element configured to close the entry opening in a first position (I) of the feeder unit and to unblock the entry opening in a second position (II) of the feeder unit. The cover element includes a thread-guiding element having an open contour.

11 Claims, 5 Drawing Sheets

(51) Int. Cl.
*B65H 75/24* (2006.01)
*D01H 1/22* (2006.01)
*D01H 4/48* (2006.01)

(58) Field of Classification Search
USPC ..... 57/22, 202, 261, 263
See application file for complete search history.

(56) References Cited

U.S. PATENT DOCUMENTS 4,497,166 A * 2/1985 Artzt ..... D01H 4/50 57/263
4,610,132 A * 9/1986 Rohner ..... B65H 69/061 57/22
4,716,718 A 1/1988 Göbbels et al.
5,090,635 A * 2/1992 Grecksch ..... B65H 67/085 242/475.1
5,195,314 A * 3/1993 Stahlecker ..... D01H 5/005 57/279
5,651,507 A * 7/1997 Ruskens ..... B65H 67/02 242/475.6
5,680,751 A * 10/1997 Premi ..... B65H 69/061 242/475.4
5,867,975 A * 2/1999 Breitenhuber ..... D01H 4/50 57/413
2003/0038206 A1 2/2003 Grecksch et al.
2006/0277890 A1* 12/2006 Grassi ..... B65H 49/20 57/1 R
2008/0217462 A1* 9/2008 Peters ..... B65H 63/036 242/476
2017/0029235 A1* 2/2017 Maleck ..... D01H 4/50

FOREIGN PATENT DOCUMENTS

DE 199 27 877 A1 12/2000
DE 10 2015 112 660 A1 2/2017
EP 2 987 756 A1 2/1916
EP 0 691 300 A1 1/1996
EP 1 283 288 A2 2/2003
EP 2444347 A2 * 4/2012 ..... B65H 57/12
JP 59031256 A * 2/1984 ..... B65H 67/085

* cited by examiner

DEVICE FOR PIECING A THREAT AT A WORKSTATION OF A TEXTILE MACHINE COMPRISING A SUCTION NOZZLE AND COMPRISING A FEEDER UNIT

FIELD OF THE INVENTION

The present invention relates to a device for piecing a thread at a workstation of a textile machine, the device including a suction nozzle for picking up a thread end of the thread from a bobbin. The suction nozzle includes a suction orifice, a suction duct, and an entry opening for the thread. The device also includes a feeder unit situated so as to be movable with respect to the suction nozzle for forming a thread loop from the thread end picked up by the suction nozzle. The feeder unit includes a cover element for closing the entry opening of the suction nozzle, as well as a thread-guiding element, and can be moved back and forth between a first position, in which the thread-guiding element is located within the suction duct and the cover element closes the entry opening of the suction nozzle, and a second position, in which the thread-guiding element is located outside the suction duct and the cover element unblocks the entry opening of the suction nozzle.

BACKGROUND

In the case of textile machines such as spinning machines or winders, in which a thread is continuously produced or delivered by a delivery bobbin and is wound onto a bobbin, the thread must be re-pieced after interruptions of the production process, such as in the case of a thread break or a clearer cut. For this purpose, it has become known to search for the end of the thread traveling on the bobbin with the aid of a suction nozzle, and to suction the end of the thread into the suction nozzle in order to transfer the end from there to further handling units for piecing.

DE 3 515 765 A1 describes a suction nozzle which is situated in a displaceable maintenance unit. After the thread has been successfully suctioned in, the suction nozzle is removed slightly away from the bobbin surface, and so the suctioned-in thread is tensioned between the suction nozzle and the bobbin. Thereafter, a feeder unit, which is also situated in the displaceable maintenance unit, is moved toward the thread. The feeder unit grasps the tensioned thread and, while forming a thread loop, transfers the thread to a further handling unit for piecing.

In addition, textile machines have become known, in which each of the workstations includes an associated suction nozzle. A textile machine of this type is described in EP 1 283 288 A2. In this case, provided at each of the workstations is a pivotably mounted suction nozzle which, in a first position, picks up the thread from the bobbin surface and, after the thread end has been successfully suctioned in, is swiveled into a second position in order to deliver the suctioned-in thread end to further handling units of the workstation. The pivotable suction nozzle requires a comparatively large amount of space and has a complex design.

Moreover, DE 10 2015 112 660 A1 describes a textile machine comprising an associated suction nozzle at each workstation, which is fixedly situated at the workstation. A movable feeder unit is assigned to the fixed suction nozzle in order to nevertheless enable the thread end to be delivered to a further handling unit of the workstation. The feeder unit includes a thread guide area which is introduced into a suction duct of the suction nozzle before the thread end is suctioned in, and so the thread end simultaneously enters the thread guide area of the feeder unit when suctioned into the suction nozzle. After the thread end has been successfully picked up, the feeder unit can be swiveled in order to deliver the thread end to the further handling unit while forming a thread loop. The suction nozzle includes an entry opening for the thread guide area of the feeder unit and for guiding the suctioned-in thread out of the suction nozzle. This entry opening must be sealed during the search for the thread end on the bobbin surface. The feeder unit comprises a cover element for this purpose.

SUMMARY OF THE INVENTION

A problem addressed by the present invention is that of providing a device for the piecing of a thread, which allows for a reliable sealing of the entry opening of the suction nozzle during the search for the thread. Additional objects and advantages of the invention will be set forth in part in the following description, or may be obvious from the description, or may be learned through practice of the invention.

In accordance with aspects of the invention, a device for piecing a thread at a workstation of a textile machine includes a suction nozzle for picking up a thread end of the thread from a bobbin, wherein the suction nozzle includes a suction orifice, a suction duct, and an entry opening for the thread. Moreover, the device includes a feeder unit situated so as to be movable with respect to the suction nozzle for forming a thread loop from the thread end picked up by the suction nozzle, wherein the feeder unit includes a cover element for closing the entry opening of the suction nozzle, as well as a thread-guiding element. The feeder unit can be moved back and forth between a first position, in which the thread-guiding element is located within the suction duct and the cover element closes the entry opening of the suction nozzle, and a second position, in which the thread-guiding element is located outside the suction duct and the cover element unblocks the entry opening of the suction nozzle. The thread-guiding element has an open contour.

Due to the fact that the thread-guiding element has an open contour and, therefore, is attached at only one of the two ends of the open contour to the feeder unit or at only one point to the cover element of the feeder unit, the cover element is only slightly stiffened by the thread-guiding element. As a result, the flexibility of the cover element is increased, and so the cover element can better adapt to the surface of the suction nozzle in the area of the entry opening. The areas of the cover element, in particular, which are not connected to the thread-guiding element can therefore adapt particularly well to the contour of the entry opening and better seal the entry opening. At the same time, the flow within the suction nozzle is less adversely affected by the open contour of the thread-guiding element, which supports the reliable suctioning-in of the thread end and results in reduced energy consumption. In addition, material can be spared as compared to a thread-guiding element having a closed contour, in particular when the thread-guiding elements are made from a sheet-metal material.

According to one advantageous embodiment of the invention, the cover element consists of a plastic material. Due to the use of a plastic material, the cover element can be designed to be particularly flexible, and so the cover element can also adapt particularly well to the contour of the suction nozzle and, therefore, can better seal the entry opening. In any case, it is advantageous when the suction nozzle consists of a harder material than the cover element or when the cover element consists of a softer material than the suction nozzle, and so the seal can be improved solely due to the vacuum prevailing in the suction nozzle, which draws the softer cover element toward the suction nozzle.

A seal of the entry opening is also improved when at least one area of the suction nozzle surrounding the entry opening is curved in the longitudinal direction of the entry opening and the cover element is also curved in its longitudinal direction. The longitudinal direction of the entry opening is understood, in this case, to be the direction of the greatest dimension of the entry opening. The longitudinal direction of the cover element is also understood to be the direction of the greatest dimension of the cover element. Due to the curved contour, the seal can be further improved, in particular, in the area of the two longitudinal ends of the cover element or in the area of the two longitudinal ends of the entry opening.

As an alternative or in addition to the curved contour of the suction nozzle and of the cover element, it is advantageous when the entry opening of the suction nozzle and the cover element each include at least one, preferably at least two opposed, beveled edges, each of which forms a sealing surface. As a result, a defined contact area between the suction nozzle and the cover element is created, which supports the seal of the entry opening due to the beveled shape. Preferably, at least the two edges of the entry opening and of the cover element extending in the longitudinal direction of the entry opening are beveled in this case. In the case of a rectangular entry opening, it is particularly preferred when all four edges delimiting the entry opening are beveled. It is also conceivable, however, to provide only one beveled edge surrounding the entry opening or surrounding the cover element, depending on the shape of the entry opening and of the cover element.

According to yet another embodiment of the invention, it is advantageous when the cover element is provided with a sealing lip on its side facing the thread-guiding element, i.e., on the side facing the suction duct of the suction nozzle in the first position of the feeder unit. The sealing lip is preferably made from a flexible plastic material. In this case, the sealing lip advantageously makes a seal possible even when there is an uneven sealing gap between the suction nozzle and the cover element. A silicone material or an elastomeric material can be utilized as the flexible plastic material.

In order to attach the sealing lip to the cover element, it is also advantageous when the cover element comprises, on its side facing the thread-guiding element, at least one holding element, preferably several mutually spaced holding elements. The sealing lip is merely fitted onto the holding element or the holding elements. Due to the fact that the sealing lip is merely loosely fitted, the sealing lip is also drawn in slightly via the vacuum in the suction nozzle during the drawing-in of the thread end, which results in an improved sealing effect. Therefore, a self-sealing design of the cover element is achieved.

In order to further improve the flexibility of the cover element, it is advantageous when the thread-guiding element is attached to the cover element off-center, relative to the longitudinal direction of the cover element, in particular on or in the area of one longitudinal end of the cover element. As a result, the seal in a central area of the cover element between the two longitudinal ends is facilitated, in particular, given a curved cover element and a curved contour of the suction nozzle.

It is also advantageous when the thread-guiding element is made from a sheet-metal material, in particular, a stainless steel or aluminum sheet-metal material. The thread-guiding element can be manufactured in a particularly easy way by punching or via lasers in this case.

It can also be advantageous when the thread-guiding element is made entirely or partially (i.e., one or more sections of the thread-guiding element) from a ceramic material. For example, it would be conceivable to manufacture the thread-guiding element or the corresponding sections thereof with the aid of a 3D printing process, followed by sintering with a ceramic layer.

Moreover, it is advantageous when the thread-guiding element is provided with a coating and/or is polished. For example, a thread-guiding element made from an aluminum sheet-metal material can be provided with an aluminum oxide layer, or a thread-guiding element made from a steel sheet-metal material can be provided with a DLC (diamond-like carbon) coating. In any case, it is advantageous when the thread-guiding element is provided with a coating which reduces the coefficient of friction. Damage to the thread can be avoided as a result. In addition, wear of the thread-guiding element can be thwarted by coatings which reduce the coefficient of friction but are wear-resistant. It is also advantageous, however, when the thread-guiding element is polished. The coefficient of friction of the thread-guiding element and, therefore, wear thereof can also be reduced as a result thereof.

In order to form the thread loop, it is also advantageous when the thread-guiding element comprises at least a first thread guide edge having a first fixing contour for a thread piece to be carried away and at least a second thread guide edge having a second fixing contour for a thread piece to be pieced. During the drawing-open of the thread loop, a first thread piece can be fixed on the first fixing contour, while a second thread piece glides across the second thread guide edge and, finally, is held in position in the second fixing contour. As a result, the two thread pieces of the thread loop are separated from each other and the thread piece to be pieced can be subsequently re-pieced.

BRIEF DESCRIPTION OF THE DRAWINGS

Further advantages of the invention are described with reference to the exemplary embodiments represented in the following. Wherein.

DETAILED DESCRIPTION

Figure 1:
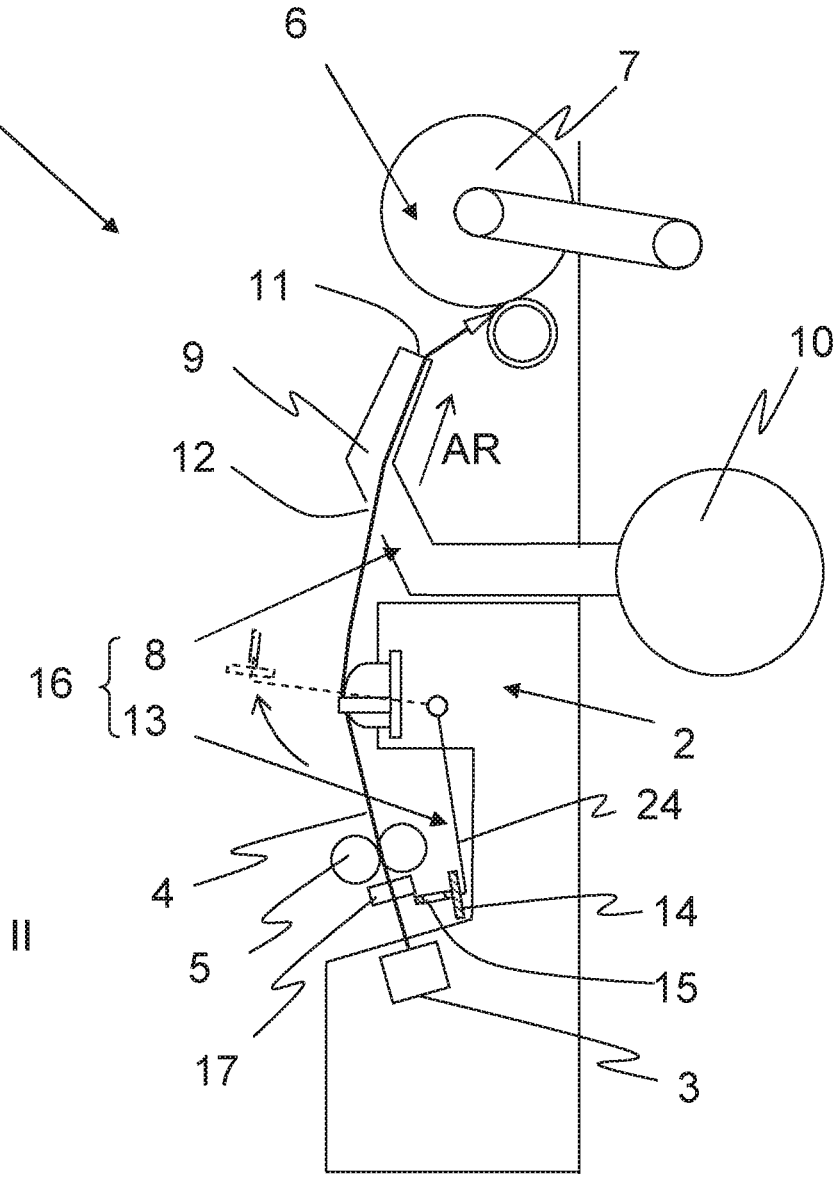
FIG. 1 shows a schematic, partially cut side view of a workstation of a textile machine during the regular operation.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the figures and exemplary embodiments, the same reference signs are utilized for identical or comparable features in each of the various figures. The individual features or components are therefore described in detail only in the first mention thereof. Unless explained separately once more in the following exemplary embodiments and figures, the design and mode of operation of the features correspond to the design and the mode of operation of the features previously described with reference to another exemplary embodiment.

FIG. 1 shows a sectional representation of a schematic side view of a workstation 2 of a textile machine 1. The textile machine 1 is designed as a spinning machine in this case and includes, as a thread-delivery device 3, a spinning device, in which a thread 4 is produced. The thread 4 is drawn off of the thread-delivery device 3 with the aid of two delivery rollers 5 and is delivered to a winding device 6, where the thread 4 is wound onto a bobbin 7. In deviation from the representation shown, it would also be possible for the textile machine 1 to be designed not as a spinning machine, but rather as a winder. In this case, the workstation 2 comprises, as a thread-delivery device 3, a delivery bobbin, from which the thread 4 is drawn off and is wound onto a bobbin 7 as described above.

Moreover, the workstation 2 of the textile machine 1 shown here is designed as an autonomous workstation 2 which is capable of automatically re-piecing a thread end 4*a* (see FIG. 2) after an interruption in production. For this purpose, the thread end 4*a* is returned into the spinning device, where the thread end 4*a* is reconnected to further fibers to be incorporated into the thread. In the case of a winder, a thread end 4*a* coming from the bobbin 7 is connected to a thread end (not shown) of the delivery bobbin. For this purpose, the workstation 2 shown here is provided with a device 16 for piecing a thread 4. The device 16 for piecing the thread 4 includes a suction nozzle 8 in this case, with the aid of which a thread end 4*a* (see FIG. 2) of the thread 4 traveling onto the bobbin 7 is sought and can be suctioned into a suction duct 9 of the suction nozzle 8. The suction nozzle 8 is connected to a vacuum duct 10 in a known way in order to apply a vacuum to the suction duct 9. The suction nozzle 8 includes a suction orifice 11 for suctioning in the thread end 4*a*. Moreover, the device 16 comprises a feeder unit 13, with the aid of which the thread end 4*a* picked up by the suction nozzle can be delivered, while forming a thread loop (see FIG. 3), to a piecing unit 17 or to another handling unit of the workstation 2 or can be delivered directly to the thread-delivery device 3. For this purpose, the feeder unit 13 includes a movably, in particular pivotably, mounted lever 24 which is provided with a thread-guiding element 15, in which the thread end 4*a* can be picked up by the suction nozzle 8. The movement of the feeder unit 13 is symbolized in this case by the arrow and the dashed-lined, second representation of the feeder unit 13.

According to the present representation, the suction nozzle 8 is fixedly situated at the workstation 2, wherein the thread 4 extends through the suction nozzle 8 during the regular operation of the workstation 2. In this case, the thread 4 enters the suction nozzle 8 through an entry opening 12 and exits the suction nozzle 8 through the suction orifice 11. The feeder unit 13 comprises a cover element 14 for closing the entry opening 12 of the suction nozzle 8. The feeder unit 13 can be displaced between a first position I (see FIG. 2) for taking the thread end 4*a* from the suction nozzle 8 and a second position II for forming the thread loop and for transferring the thread end 4*a*. In the second position II of the feeder unit 13, which is shown here, the thread-guiding element 15 is located outside the suction duct 9 of the suction nozzle 8 and the cover element 14 unblocks the entry opening 12 of the suction nozzle 8, and so the thread 4 can extend through the suction nozzle 8 during production.

If an interruption in production now occurs, for example, due to a thread break or a clearer cut, a thread end 4*a* (see FIG. 2) is formed, which travels onto the bobbin 7 since the bobbin 7 is still rotating. Therefore, it is necessary to search for the thread end 4*a* traveling onto the bobbin 7 with the aid of the suction nozzle 8 and to suction the thread end 4*a* into the suction nozzle 8.

Figure 2:
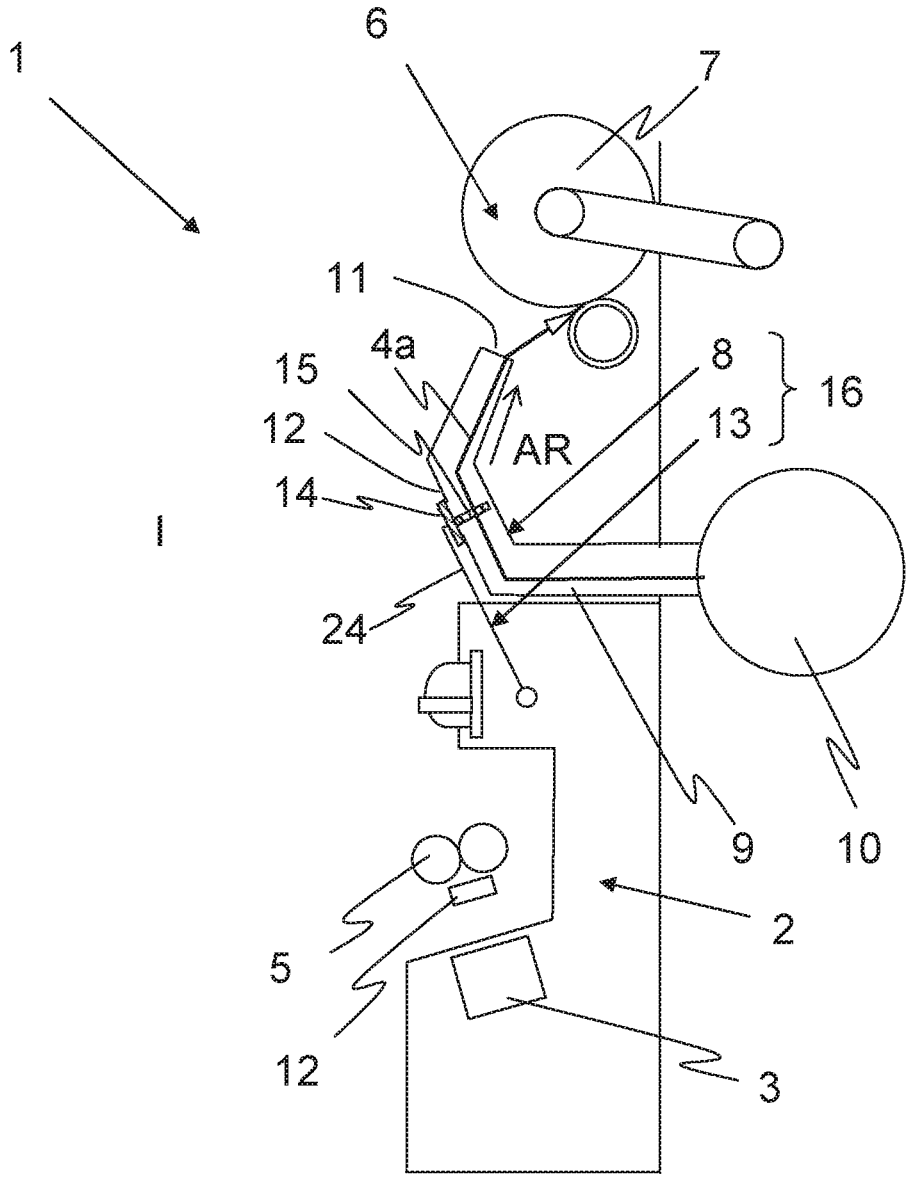
FIG. 2 shows the workstation from FIG. 1 after an interruption of the regular operation, wherein a thread has been suctioned into a suction nozzle.

FIG. 2 shows the workstation 2 of the textile machine 1 in a situation in which, after an interruption in production, the thread end 4*a* has just been suctioned into the suction nozzle 8. In order to search for the thread end 4*a* on the bobbin 7, the feeder unit 13 is initially moved into its first position I, being pivoted in this case. In this position I, the thread-guiding element 15 is located within the suction duct 9 of the suction nozzle 8 and the cover element 14 closes the entry opening 12 of the suction nozzle 8. Vacuum can now be applied to the suction nozzle 8 via the vacuum duct 10 and the suction duct 9 can search for the thread end 4*a* on the surface of the bobbin 7. When the thread end 4*a* is suctioned in, the thread end 4*a* enters not only the suction duct 9 of the suction nozzle 8, but also, simultaneously, the thread-guiding element 15 of the feeder unit 13. The thread end 4*a* is now held within the suction nozzle 8 via the suction draught. It is necessary to reliably seal the entry opening 12 with the aid of the cover element 14 while vacuum is being applied to the suction nozzle 8 in order to not adversely affect the effect of the vacuum in the suction nozzle 8 and, in addition, to reduce the energy consumption of the textile machine 1.

Figure 3:
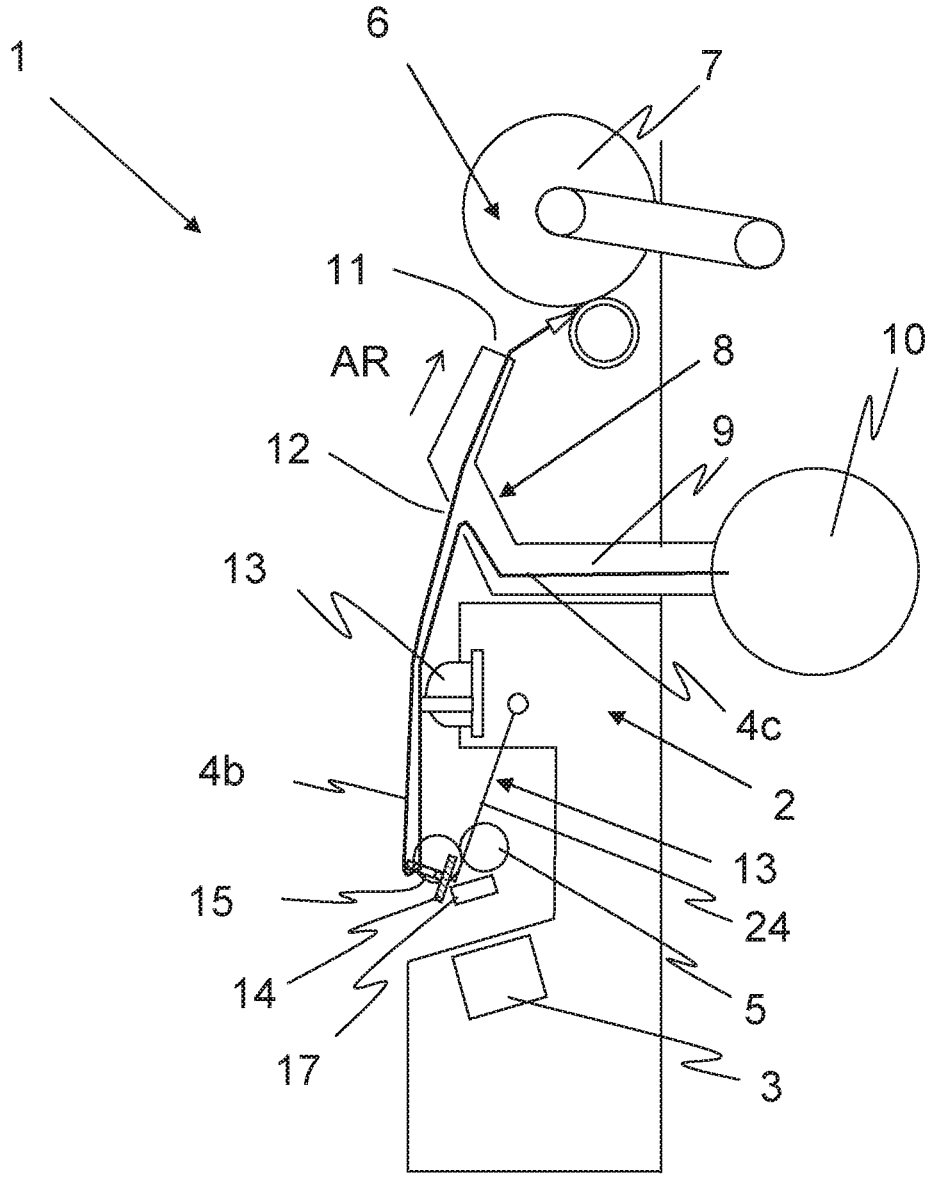
FIG. 3 shows the workstation of the textile machine from FIG. 1 during the formation of a thread loop.

Finally, FIG. 3 shows yet another situation of the workstation 2 of the textile machine 1, in which the suctioned-in thread end 4*a* is delivered to the piecing unit 17, in this case, while forming a thread loop. For this purpose, the feeder unit 13 is moved from its first position I (see FIG. 2) back into its second position II, in which the cover element 14 unblocks the entry opening 12 and the thread-guiding element 15 is located outside the suction duct 9. By drawing the thread loop open, the original thread end 4*a* is now transformed into a thread piece 4*b* to be pieced and a thread piece 4*c* to be carried away. The two thread pieces 4*b* and 4*c* can now be separated, for example, with the aid of the piecing unit 17, and so the thread piece 4*b* can be delivered to the thread-delivery device 3 for piecing and the thread piece 4*c* can be suctioned into the vacuum duct and discarded thereby.

Figure 4:
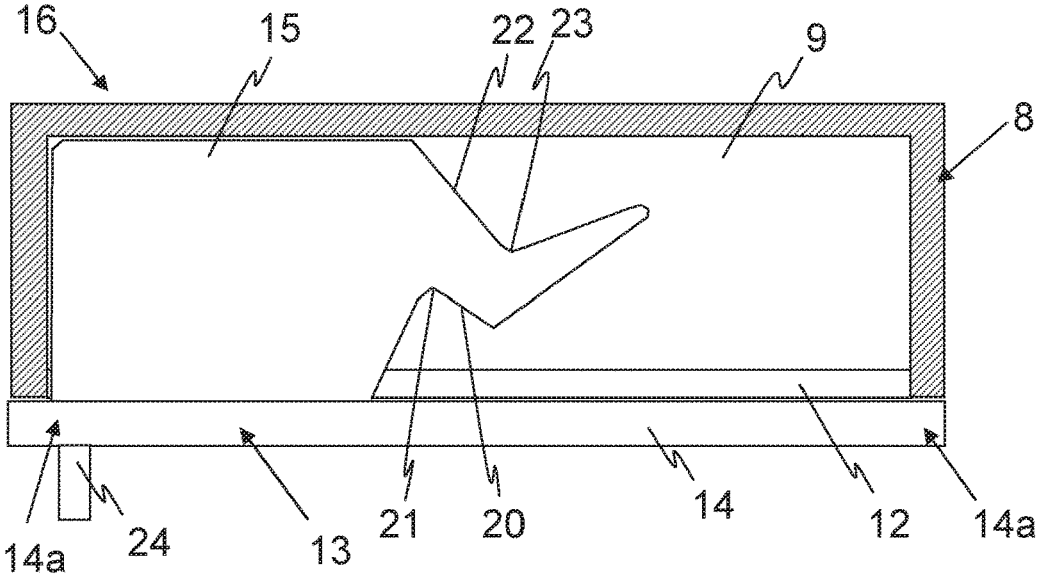
FIG. 4 shows a schematic cross-sectional representation of a device for piecing a thread end, according to a first embodiment.

In order to now facilitate the sealing of the entry opening 12 with the aid of the cover element 14 during the suctioning-in of the thread end 4*a*, the thread-guiding element 15 is no longer designed as a closed contour in the form of an eyelet, as was the case previously, but rather as an open contour. This is represented in FIG. 4 which shows a schematic cross-sectional representation of the device 16 including the suction nozzle 8 including the suction duct 9 as well as the feeder unit 13. The feeder unit 13 is represented in its first position I in this case, in which the cover element 14 closes the entry opening 12 of the suction nozzle 8 and the thread-guiding element 15 is located in the suction duct 9. The thread-guiding element 15 is situated off-center in this case, relative to the longitudinal direction of the cover element 14. In this case, the thread-guiding element 15 is situated in the area of one longitudinal end 14*a* of the cover element 14. As a result, the cover element 14 can flexibly adapt to the entry opening 12, in particular, at the other longitudinal end 14*a* which is positioned opposite the first longitudinal end 14*a* at which the thread-guiding element 15 is situated.

Due to the fact that there is a vacuum within the suction duct 9 at least during the search for the thread, it is also possible for the free longitudinal end 14*a* to be suctioned onto the entry opening 12 of the suction nozzle 8 via the vacuum, which supports the sealing effect of the cover element 14. Moreover, FIG. 4 shows a first thread guide edge 20, along which the thread piece 4*c* to be carried away glides during the drawing-open of the thread loop (see FIG. 3), until the thread piece 4*c* is finally fixed at a first fixing contour 21. In addition, the thread piece 4*b* to be pieced glides along a second thread guide edge 22 during the further drawing-open of the thread loop, until the thread piece 4*b* is finally fixed at a second fixing contour 23. After the thread loop has been drawn completely open, the thread piece 4*b* to be pieced and the thread piece 4*c* to be carried away are therefore separated from each other by the thread-guiding element 15 and can therefore be cut in two, as described above.

Figure 5:
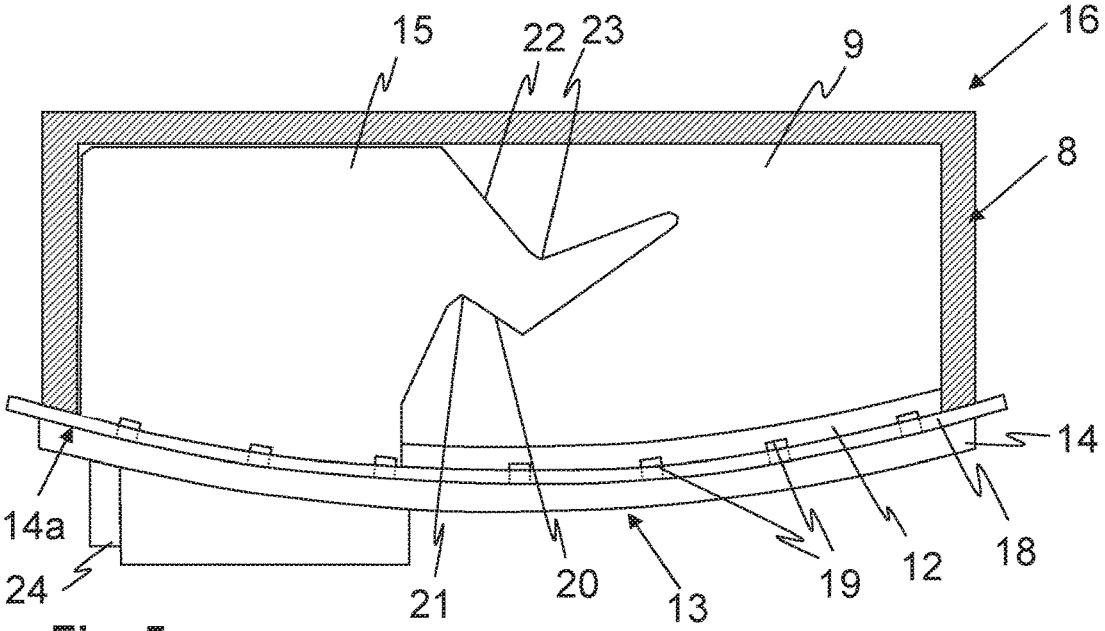
FIG. 5 shows a schematic cross-sectional representation of a device for piecing a thread end, according to a second embodiment.

FIG. 5 shows another embodiment of a device 16 for piecing a thread end 4*a*, in which the cover element 14 is curved in its longitudinal direction. In the case of the suction nozzle 8 as well, at least the area of the suction nozzle 8 surrounding the entry opening 12 is curved in its longitudinal direction. The longitudinal direction corresponds to the greatest dimension of the slot-shaped entry opening 12 in this case. The sealing of the entry opening 12 by the cover element 14 is facilitated as a result. Moreover, a sealing lip 18 is shown in FIG. 5, which has been installed on the cover element 14 and also facilitates the sealing of the entry opening 12. The cover element 14 and the sealing lip 18 are particularly resilient, in particular, when the cover element 14 as well as the sealing lip 18 are made from a plastic material, and so an improved seal can be achieved solely by way of the cover element 14, including the sealing lip 18, being drawn in via the vacuum. An increased contact pressure onto the cover element 14, for example, by way of a drive of the feeder unit 13, is not necessary in this case. The sealing lip 18 is situated, in this case, on the side of the cover element 14 facing the thread-guiding element 15 and, therefore, on the inside of the cover element 14 and is connected to the suction duct 9 and, therefore, also to the vacuum prevailing therein during the suctioning. By contrast, the side of the cover element 14 facing away from the thread-guiding element 15 faces the outside of the suction nozzle 8.

In order to enable the sealing lip 18 to be attached to the cover element 14, the cover element 14 comprises several holding elements 19 in this case, onto which the sealing lip 18 has been fitted. The holding elements 19 are spaced from each other in this case, and so the sealing lip 18 is not connected to the cover element 14 over the entire surface thereof. The sealing lip 18 can therefore move with respect to the cover element 14, which facilitates the suctioning-in of the sealing lip 18 by the vacuum prevailing within the suction duct 9.

Figure 6:
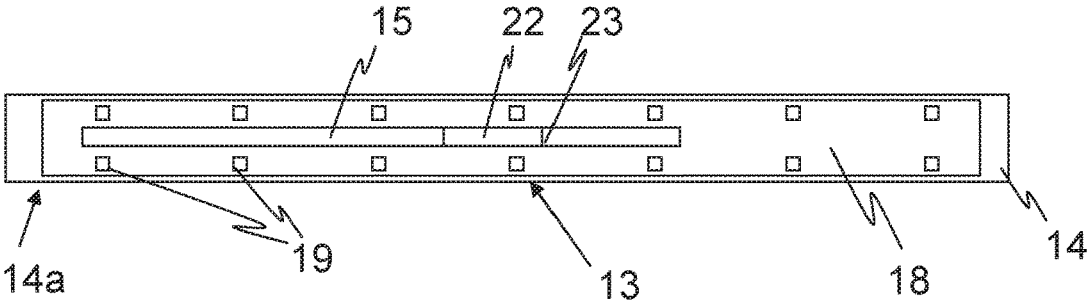
FIG. 6 shows a detailed view of a cover element comprising a sealing lip for sealing an entry opening of the suction nozzle.

FIG. 6 shows a top view of the inner side or the side of the cover element 14 facing the thread-guiding element 15, onto which the sealing lip 18 is installed. According to the present representation, the holding elements 19 are situated in two rows, namely above and below the thread-guiding element 15 in this case. It would also be conceivable to provide only one row of holding elements 19 which would then be situated to the left and the right of the thread-guiding element 15 relative to the representation in FIG. 6. Moreover, it would also be conceivable, of course, to provide a total of only 2 or 3 holding elements at different points of the cover element 14.

Figure 7:
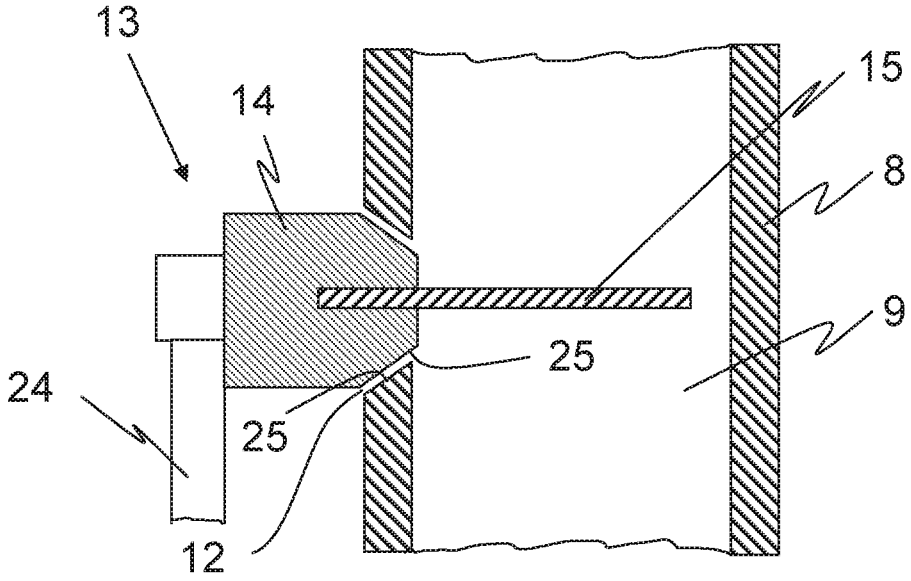
FIG. 7 shows a schematic, truncated longitudinal representation of a device for piecing a thread end, according to a further, alternative embodiment.

FIG. 7 shows a schematic, truncated longitudinal representation of a device 16 for piecing a thread end 4*a* according to a further, alternative embodiment. In this case, the entry opening 12 of the suction nozzle 8 comprises two beveled edges which are positioned opposite each other and extend in the longitudinal direction of the entry opening 12. The beveled edges each form a sealing surface 25 for the cover element 14. With respect to the cover element 14 as well, the two edges extending in the longitudinal direction of the entry opening 12 are beveled and form sealing surfaces 25. Preferably, all the edges delimiting the entry opening 12 and all the edges of the cover element 14 are beveled or are provided with a circumferential, beveled edge in order to achieve a particularly good seal. It is understood that the edges of the cover element 14 are beveled in a manner corresponding to the edges of the entry opening 12 in each case, and so the entry opening 12 is designed as a positive shape and the cover element 14 is correspondingly designed as a negative shape.

The invention is not limited to the exemplary embodiments which have been represented. Modifications and combinations within the scope of the claims are also covered by the invention, even if they are not represented in the exemplary embodiments or their individual features are represented in various exemplary embodiments.

LIST OF REFERENCE SIGNS

1 textile machine
2 workstation
3 thread-delivery device
4 thread
4*a* thread end
4*b* thread piece to be pieced
4*c* thread piece to be carried away
5 delivery device
6 winding device
7 bobbin
8 suction nozzle
9 suction duct
10 vacuum duct
11 suction orifice
12 entry opening
13 feeder unit
14 cover element
14*a* longitudinal end of the cover element
15 thread-guiding element
16 device for piecing the thread
17 piecing unit
18 sealing lip
19 holding element
20 first thread guide edge
21 first fixing contour
22 second thread guide edge
23 second fixing contour
24 lever
25 sealing surface
I first position of the feeder unit
II second position of the feeder unit

The invention claimed is:

1. A device for piecing a thread at a workstation of a textile machine, comprising:

a suction nozzle mounted at the workstation and configured to pick up a thread end of the thread from a bobbin, the suction nozzle comprising an entry opening for the thread, a suction orifice, and a suction channel;

a feeder unit movable with respect to the suction nozzle and comprising a cover element configured to close the entry opening in a first position (I) of the feeder unit and to unblock the entry opening in a second position (II) of the feeder unit, the feeder unit configured to form a loop from the thread end sucked into the suction nozzle; and the cover element comprising a thread-guiding element having an open contour, the thread-guiding element disposed within the suction channel in the first position (I) of the feeder unit and outside of the suction channel in the second position (II) of the feeder unit.

2. The device as in claim 1, wherein the cover element is formed of a plastic material.

3. The device as in claim 1, wherein at least one area of the suction nozzle surrounding the entry opening is curved in a longitudinal direction of the entry opening, and the cover element is also correspondingly curved in a longitudinal direction of the cover element.

4. The device as in claim 1, wherein the entry opening of the suction nozzle and the cover element each comprise opposed beveled edges that form a sealing surface.

5. The device as in claim 1, wherein the cover element comprises a sealing lip on a side thereof facing the thread-guiding element, the sealing lip formed of a flexible plastic material.

6. The device as in claim 5, wherein the cover element further comprises at least one holding element on the side thereof facing the thread-guiding element onto which the sealing lip is fitted.

7. The device as in claim 1, wherein the thread-guiding element is attached to the cover element off-center relative to a longitudinal direction of the cover element.

8. The device as in claim 1, wherein the thread-guiding element is made from a sheet-metal material.

9. The device as in claim 1, wherein the thread-guiding element comprises, at least in sections, a ceramic material.

10. The device as in claim 1, wherein the thread-guiding element is polished or comprises a coating.

11. The device as in claim 1, wherein the thread-guiding element comprises a first thread guide edge having a first fixing contour for a thread piece to be carried away and a second thread guide edge having a second fixing contour for the thread piece to be pieced.

* * * * *